United States Patent [19]

Patten

[11] 3,983,846

[45] Oct. 5, 1976

[54] BOILER DEVICE

[75] Inventor: William B. Patten, Cottage Grove, Oreg.

[73] Assignee: The Raymond Lee Organization, Inc., New York, N.Y. ; a part interest

[22] Filed: Sept. 22, 1975

[21] Appl. No.: 615,203

[52] U.S. Cl. ..... 122/322; 122/250 R; 122/338; 122/460

[51] Int. Cl.[2] ..... F22B 21/22

[58] Field of Search ..... 122/322, 323, 338, 460, 122/476, 250 R

[56] References Cited

UNITED STATES PATENTS

| | | | |
|---|---|---|---|
| 761,713 | 6/1904 | Restucci | 122/323 |
| 1,300,087 | 4/1919 | Wood | 122/338 |
| 1,365,713 | 1/1921 | MacDonald | 122/338 |
| 2,518,459 | 4/1950 | Frisch | 122/323 |
| 2,567,696 | 9/1951 | Kessler | 122/322 |
| 2,790,435 | 4/1957 | Johnson | 122/338 |

*Primary Examiner*—Kenneth W. Sprague
*Attorney, Agent, or Firm*—Daniel Jay Tick

[57] ABSTRACT

A boiler device comprises a cold water input for supplying cold water through a feed water heating system. A bottom ring is spaced from and positioned below the heating system for producing uniform distribution of feed water. A delivery pipe supplies heated water from the heating system to the bottom ring. The delivery pipe extends from the heating system to a point spaced from and above the bottom ring. A generating coil system is provided above the bottom ring for heating water supplied from the bottom ring and producing steam. A superheater coil system is provided above the generating coil system for superheating steam. Incline headers between the generating coil system and the superheater coil system supply steam from the generating coil system to the superheater coil system. A standpipe supplies superheated steam from the superheater coil system to an upper ring above the superheater coil system for storing superheated steam.

1 Claim, 5 Drawing Figures

BOILER DEVICE

DESCRIPTION OF THE INVENTION

The present invention relates to a boiler device.

Objects of the invention are to provide a boiler device of simple structure, having no dead end pipes, so that it has continuous free flowing circulation, which boiler device is entirely encased in an insulated jacket, prevents hydraulic surge to the superheater system when a sudden demand is imposed on the steam supply, provides spacers of flattened pipe between the coils of the generating coil system to prevent strain on welded parts of the coils caused by rapid fire-up of a cold boiler, uniformly distributes feed water as it enters the boiler, uniformly distributes steam as it leaves the boiler, prevents siphoning of boiler water, and functions efficiently, effectively and reliably to provide desired volumes of steam.

In order that the invention may be readily carried into effect, it will now be described with reference to the accompanying drawing, wherein.

Figure 2:
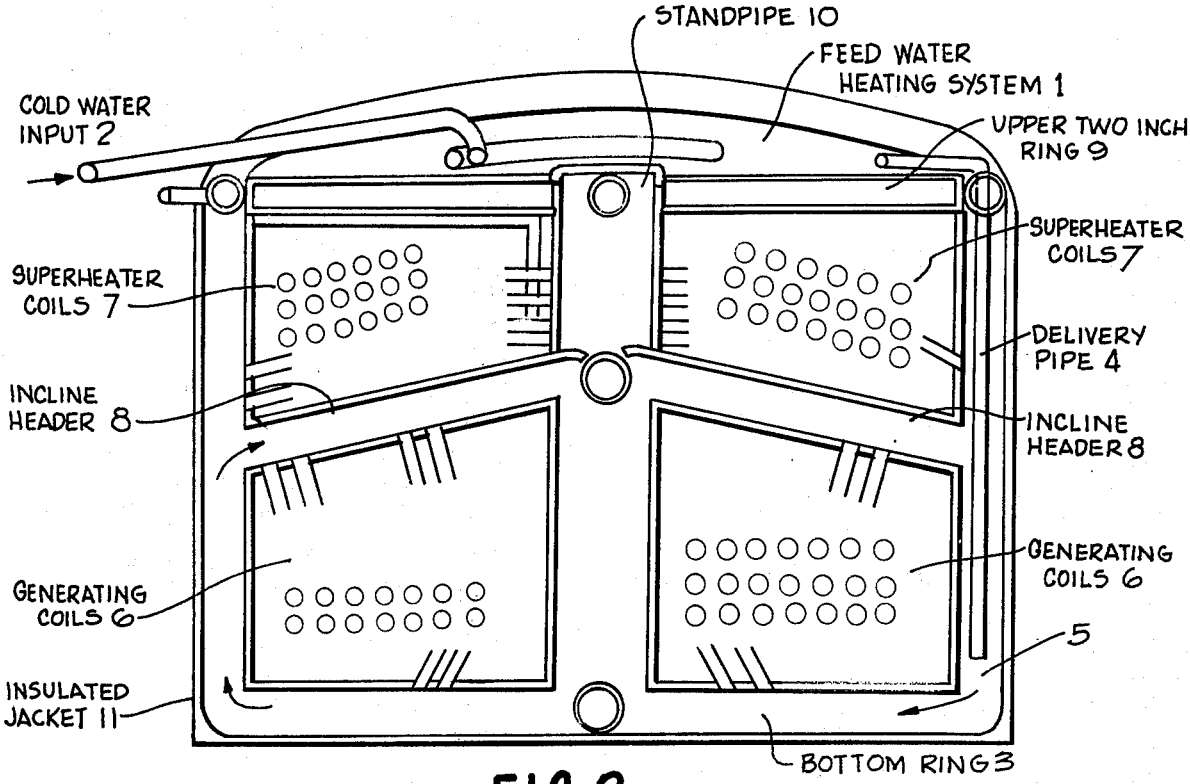
FIG. 2 is a cross-sectional view, on an enlarged scale, taken along the lines II—II, of FIG. 1.
Figure 1:
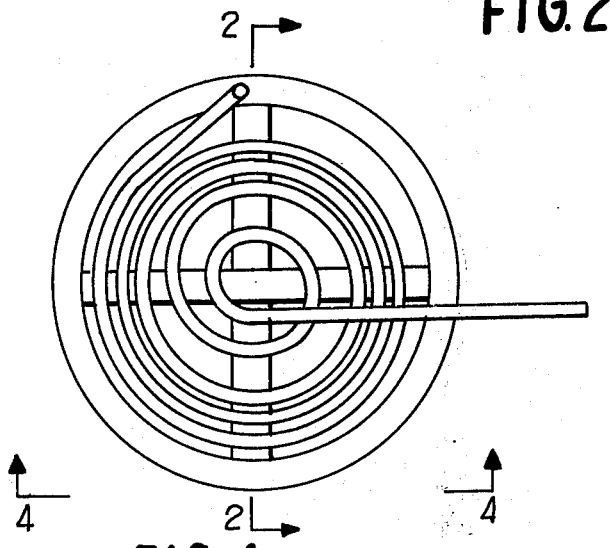
FIG. 1 is a top view of an embodiment of the boiler device of the invention.
Figure 3:
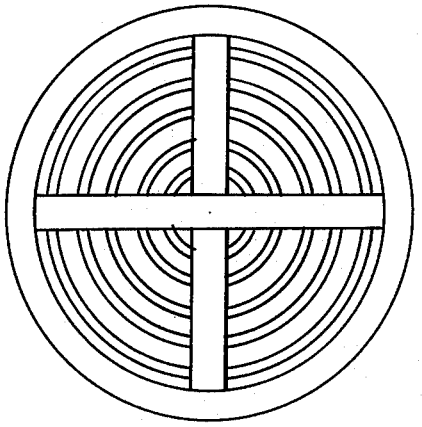
FIG. 3 is a bottom view of the embodiment of FIG. 1.
Figure 5:
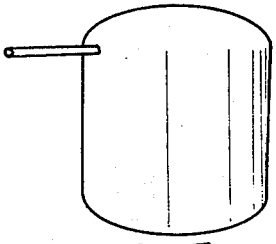
FIG. 5 is a perspective view of the boiler device of the invention.
Figure 4:
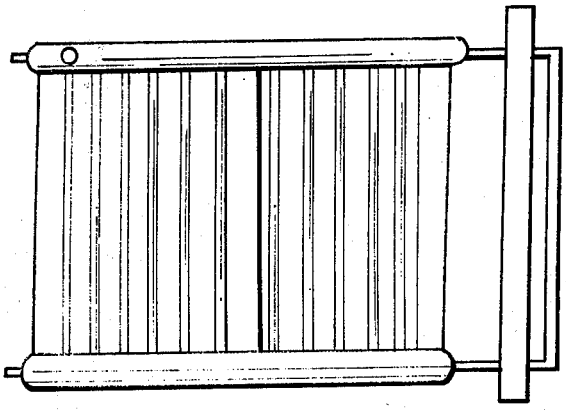
FIG. 4 is a side view, taken along the lines IV—IV of FIG. 1.

As shown in FIG. 2, the boiler device of the invention comprises a feed water heating system 1. A cold water input 2 supplies cold water through the feed water heating system 1.

A bottom ring 3 is spaced from and positioned below the heating system 1 and produces uniform distribution of the feed water. A delivery pipe 4 supplies heated water from the heating system 1 to the bottom ring 3. The delivery pipe 4 extends from the heating system 1 to a point 5 spaced from and above the bottom ring 3.

A generating coil system 6, comprising a plurality of generating coils in predetermined spaced relation to each other, is positioned above the bottom ring 3 for heating water supplied from said bottom ring. The generating coil system converts the water to steam.

A superheater coil system 7 comprising a plurality of superheater coils positioned in predetermined spaced relation to each other, is positioned above the generating coil system 6 and converts the steam produced by the generating coil system to superheated steam.

Incline headers 8 are provided between the generating coil system 6 and the superheater coil system 7 for supplying steam from said generating coil system 6 to said superheater coil system.

An upper 2 inch ring 9 is positioned above the superheater coil system 7 for storing superheated steam.

A standpipe 10 supplies superheated steam from the superheater coil system 7 to the upper ring 9. The upper ring 9 stores the superheated steam until such time as it is required.

The entire boiler device is encased in an insulated jacket 11.

The heating is below the entire boiler, not above the bottom ring, and heat flows around all the pipes, so that the entire system is considered the heating surface.

There is a 3/8 inch hole in the top ring above every 2 inch upright pipe, and stainless steel disc baffle plates are provided in the standpipe 10. These holes and baffle plates, which are not shown in the FIGS., are built in checks against hydraulic surge, and prevent water dance above the crown sheet, which was a problem with the "Stanley Steamer" at 60 m.p.h. constant velocity.

The end of the delivery pipe 4 is about 4 inches above the bottom ring 3, since this is a safety factor in the event that the water pump fails. This shuts off the fuel and prevents burn out of the boiler.

The delivery pipe 4 has a 1/8 inch hole near the top of the boiler in order to break the vacuum, to prevent water from being syphoned out of the boiler after the fire is extinguished.

Since water or steam moves over the entire length of the pipes, very little scale is deposited in the boiler.

While the invention has been described by means of a specific example and in a specific embodiment, I do not wish to be limited thereto, for obvious modifications will occur to those skilled in the art without departing from the spirit and scope of the invention.

I claim:

1. A boiler device, comprising feed water heating means;

cold water input means for supplying cold water through the heating means;

a bottom ring spaced from and positioned below the heating means for producing uniform distribution of feed water;

delivery pipe means for supplying heated water from the heating means to the bottom ring, said delivery pipe means extending from the heating means to a point spaced from and above the bottom ring;

generating coil means above the bottom ring for heating water supplied from the bottom ring and producing steam;

superheater coil means above the generating coil means for superheating steam;

incline header means between the generating coil means and the superheater coil means for supplying steam from the generating coil means to the superheater coil means;

upper ring means above the superheater coil means for storing superheated steam; and standpipe means for supplying superheated steam from the superheater coil means to the upper ring means.

* * * * *